US012618414B2

(12) United States Patent
Wangler et al.

(10) Patent No.: US 12,618,414 B2
(45) Date of Patent: May 5, 2026

(54) APPARATUS TO REDUCE BEARING FAILURE

(71) Applicant: General Electric Company, Evendale, OH (US)

(72) Inventors: Adam Joseph Wangler, Evendale, OH (US); Bugra H. Ertas, Niskayuna, NY (US); Veera Venkata Amarnath Manem, Bengaluru (IN)

(73) Assignee: General Electric Company, Evendale, OH (US)

( * ) Notice: Subject to any disclaimer, the term of this patent is extended or adjusted under 35 U.S.C. 154(b) by 0 days.

(21) Appl. No.: 19/177,992

(22) Filed: Apr. 14, 2025

(65) Prior Publication Data

US 2025/0257736 A1 Aug. 14, 2025

Related U.S. Application Data

(63) Continuation of application No. 18/356,690, filed on Jul. 21, 2023, now Pat. No. 12,281,657.

(30) Foreign Application Priority Data

Dec. 19, 2022 (IN) ..... 202211073553

(51) Int. Cl.
*F04D 29/057* (2006.01)
*F04D 29/66* (2006.01)
*F04D 17/10* (2006.01)

(52) U.S. Cl.
CPC ..... *F04D 29/057* (2013.01); *F04D 29/668* (2013.01); *F04D 17/10* (2013.01)

(58) Field of Classification Search
CPC ..... F04D 29/057; F04D 29/668; F04D 17/10
See application file for complete search history.

(56) References Cited

U.S. PATENT DOCUMENTS

| | | | | |
|---|---|---|---|---|
| 9,238,973 | B2 | 1/2016 | Klusman | |
| 9,366,286 | B2 | 6/2016 | Omori | |
| 9,657,594 | B2 | 5/2017 | Klusman | |
| 9,689,277 | B2 | 6/2017 | Klusman | |
| 10,385,915 | B2 | 8/2019 | Himmelmann | |
| 11,125,109 | B2 | 9/2021 | Nayak et al. | |
| 2007/0069597 | A1 | 3/2007 | Taniguchi | |
| 2007/0164626 | A1* | 7/2007 | Taniguchi | F04D 29/05 310/90.5 |

(Continued)

FOREIGN PATENT DOCUMENTS

| | | | |
|---|---|---|---|
| JP | 2008232289 | A | 10/2008 |
| WO | 2013150958 | A1 | 10/2013 |
| WO | 2015087677 | A1 | 6/2015 |

*Primary Examiner* — Sabbir Hasan
(74) *Attorney, Agent, or Firm* — Hanley, Flight & Zimmerman, LLC

(57) ABSTRACT

Methods, apparatus, systems, and articles of manufacture are disclosed to reduce failure to bearings in a pump system. Disclosed herein is a pump system comprising a shaft connected to an impeller of the pump system, and a bearing to provide a dampening to the shaft, the bearing including a journal lining, the journal lining supported in the pump system, a spring-loaded foil to separate the shaft from the journal lining, an inner lining between the shaft and the spring-loaded foil, and a deformation limiter located between the spring-loaded foil and the journal lining.

12 Claims, 9 Drawing Sheets

(56) References Cited

U.S. PATENT DOCUMENTS

| | | | | |
|---|---|---|---|---|
| 2013/0205803 | A1* | 8/2013 | Xu | F01D 5/186<br>29/889.22 |
| 2016/0356310 | A1 | 12/2016 | Yoshino | |
| 2019/0195129 | A1 | 6/2019 | Morris | |

* cited by examiner

APPARATUS TO REDUCE BEARING FAILURE

CROSS-REFERENCE TO RELATED APPLICATIONS

This application arises as a continuation of U.S. patent application Ser. No. 18/356,690 (now U.S. Pat. No. 12,281,657), filed on Jul. 21, 2023, which claims priority to and the benefit of Indian patent application Ser. No. 202211073553, filed on Dec. 19, 2022. U.S. patent application Ser. No. 18/356,690 and Indian patent application Ser. No. 202211073553 are hereby incorporated herein by reference in their entireties. Priority to U.S. patent application Ser. No. 18/356,690 and Indian patent application Ser. No. 202211073553 is hereby claimed.

FIELD OF THE DISCLOSURE

This disclosure relates generally to fluid pumps and, more particularly, to an apparatus to reduce bearing failure.

BACKGROUND

Aircraft typically include various accessory systems supporting the operation of the aircraft and/or its gas turbine engine(s). For example, such accessory systems may include a lubrication system that lubricates components of the engine(s), an engine cooling system that provides cooling air to engine components, an environmental control system that provides cooled air to the cabin of the aircraft, and/or the like. Such accessory systems also include bearings of various types to enable proper operation of the accessory systems.

Figure 1:
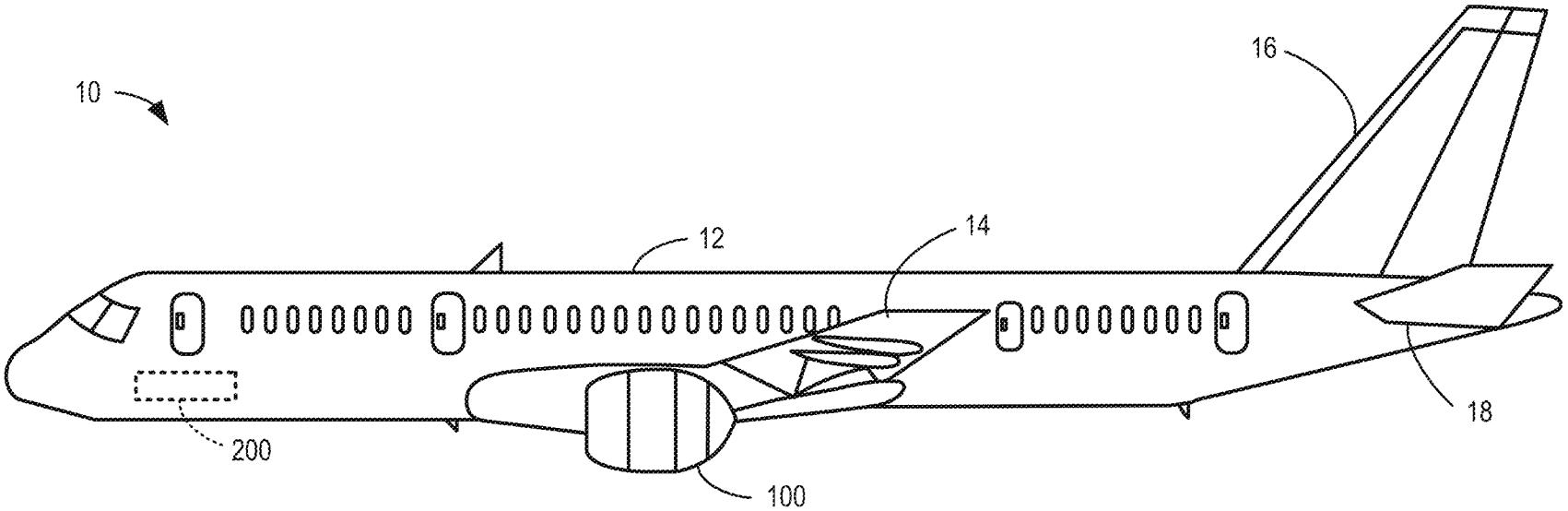
FIG. 1 is a side view of an example aircraft.

In general, the same reference numbers will be used throughout the drawing(s) and accompanying written description to refer to the same or like parts. The figures are not to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular.

DETAILED DESCRIPTION

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of: other parts therebetween, without other parts therebetween, with the first and second parts touching, or without the first and second parts being in direct contact with one another.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween.

As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

As used herein, "approximately" and "about" modify their subjects/values to recognize the potential presence of variations that occur in real world applications. For example, "approximately" and "about" may modify dimensions that may not be exact due to manufacturing tolerances and/or other real world imperfections as will be understood by persons of ordinary skill in the art. For example, "approximately" and "about" may indicate such dimensions may be within a tolerance range of +/−10% unless otherwise specified in the below description.

The terms "forward" and "aft" refer to relative positions within a gas turbine engine, pump, or vehicle, and refer to the normal operational attitude of the gas turbine engine, pump, or vehicle. For example, with regard to a gas turbine engine, forward refers to a position closer to an engine inlet and aft refers to a position closer to an engine nozzle or exhaust. Further, with regard to a pump, forward refers to a position closer to a pump inlet and aft refers to a position closer to an end of the pump opposite the inlet.

The terms "upstream" and "downstream" refer to the relative direction with respect to a flow in a pathway. For example, with respect to a fluid flow, "upstream" refers to the direction from which the fluid flows, and "downstream" refers to the direction to which the fluid flows.

As used herein, "radially" is used to express a point or points along a radial vector originating at a central axis of a rotating body and pointing perpendicularly outward from the central axis. In some examples, two gears are said to be radially connected or coupled, meaning that the two gears are in physical contact with each other at point(s) along the circumferential outer edge surface of the gears via interlocking gear teeth. In some examples, two pulleys are said to be radially connected or coupled, meaning that the two pulleys are in physical contact with a drive belt at point(s) along the circumferential outer edge surface of the pulleys.

Centrifugal fluid pumps move fluid through systems by converting rotational kinetic energy of an impeller to hydrodynamic energy of a flowing fluid. In other words, the angular velocity of the impeller is directly proportional to the flow rate of the flowing fluid exiting the pump. The impeller provides a change in rotational kinetic energy from an electric motor applying mechanical work to an impeller shaft coupled to the impeller and to the rotor of the electric motor. The rotor is provided a change in mechanical work over a period of time (i.e., mechanical power) from a stator in the electric motor applying electromagnetic forces to the rotor in the form of torque. If the motor supplies a constant amount of electrical energy to the stator, then the rotor will supply a constant amount of mechanical energy to the impeller. In this case, the mechanical power supplied to the pump by the electric motor would be equal to the quotient of the rotational kinetic energy and the amount of time the power is being supplied. In rotational systems, such as a centrifugal fluid pump, the mechanical power of the impeller is equal to the product of the torque and the angular velocity. If the rotor of the electric motor and the impeller shaft of the centrifugal fluid pump are coupled axially (e.g., by a magnetic coupling), then the torque and angular velocity of the rotor would transfer to the impeller, via the coupled shafts, and would be of the same values.

In some examples of fluid pump systems, a motor shaft (e.g., a rotor) can be axially coupled to an impeller shaft via a magnetic coupling. Magnetic couplings transfer torque between two shafts without physical contact between the shafts. In some examples, the magnetic coupling can be in the form of an inner hub fastened to a first shaft (e.g., an impeller shaft) and an outer hub fastened to a second shaft (e.g., a rotor shaft). In the example outer hub, there are a series of magnets (e.g., bar magnets) positioned to surround the example inner hub with each magnet having an opposite charge of the preceding magnet in the series. In the inner hub, a similar series of magnets are positioned around an axis of rotation of the first shaft. In some examples, the outer hub and inner hub have the same number of magnets. Because magnets of opposite charges are attracted to each other via magnetic fields, when the outer hub is positioned around the inner hub, a rotation of the outer hub causes the inner hub to rotate at the same rate. In other words, the example inner hub and the example outer hub are rotatably interlocked. This type of magnetic coupling can be referred to as a co-axial magnetic coupling. Because there is no physical contact between the inner hub and outer hub of the co-axial magnetic coupling, a containment barrier can be fastened to the housing surrounding the inner hub such that no fluid can pass from the inner hub side to the outer hub side.

Foil bearings are included in fluid pump systems to act as buffers preventing shafts (e.g., a rotor shaft, a radial shaft, etc.) from contacting with a lining surrounding the shaft and allowing relative motion between the shaft and the lining. In some examples, the foil bearing may become damaged when the shaft exerts too much force on the foil bearing, causing permanent deformation to the foil bearing and ultimately causing damage to the pump system. In such an example, the foil bearing is rated to support a load applied to the foil bearing by the shaft, and when the shaft exceeds that load, the foil bearing becomes damaged.

Certain examples provide an improved bearing design that resists damage caused by the forces applied by aircraft engines, the forces of flight of an aircraft, and the forces applied by pump systems. As discussed further below, certain examples provide an improved bearing design to improve the integrity, stability, and reliability of bearings used in apparatus such as the aircraft, engine, and pump described below.

FIG. 1 is a side view of an example aircraft 10. As shown, the aircraft 10 includes a fuselage 12 and a pair of wings 14 (one is shown) extending outward from the fuselage 12. In the illustrated example of FIG. 1, a gas turbine engine 100 is supported on each wing 14 to propel the aircraft through the air during flight. Additionally, as shown, the aircraft 10 includes a vertical stabilizer 16 and a pair of horizontal stabilizers 18 (one is shown). However, in alternative examples, the aircraft 10 may be configured differently, such as with a different number and/or type of engines.

Furthermore, the aircraft 10 may include a thermal management system 200 for transferring heat between fluids supporting the operation of the aircraft 10. More specifically, the aircraft 10 may include one or more accessory systems configured to support the operation of the aircraft 10. For example, such accessory systems include a lubrication system that lubricates components of the engines 100, a cooling system that provides cooling air to components of the engines 100, an environmental control system that provides cooled air to the cabin of the aircraft 10, and/or the like. In such examples, the thermal management system 200 is configured to transfer heat to and/or from one or more fluids supporting the operation of the aircraft 10 (e.g., the oil of the lubrication system, the air of the cooling system and/or the environmental control system, and/or the like) from and/or to one or more other fluids supporting the operation of the aircraft 10 (e.g., the fuel supplied to the engines 100). However, in alternative examples, the thermal management system 200 may be configured to transfer heat between other fluids supporting the operation of the aircraft 10.

In addition to the thermal management system 200, the aircraft 10 is subjected to various forces during operation which include aerodynamic forces (e.g., lift, thrust, drag, gravity), vibration forces, shear forces, etc. As such, components within the aircraft 10 (e.g., such as the example thermal management system 200, the engine 100, etc.) need to withstand such forces without failure to ensure the aircraft 10 functions properly. Failure to the thermal management system 200 due to excessive forces can lead to failure of the engine 100 or failure to other systems on the aircraft 10.

The configuration of the aircraft 10 described above and shown in FIG. 1 is provided only to place the present subject matter in an example field of use. Thus, the present subject matter may be readily adaptable to any manner of aircraft and/or any other suitable heat transfer application.

Figure 2:
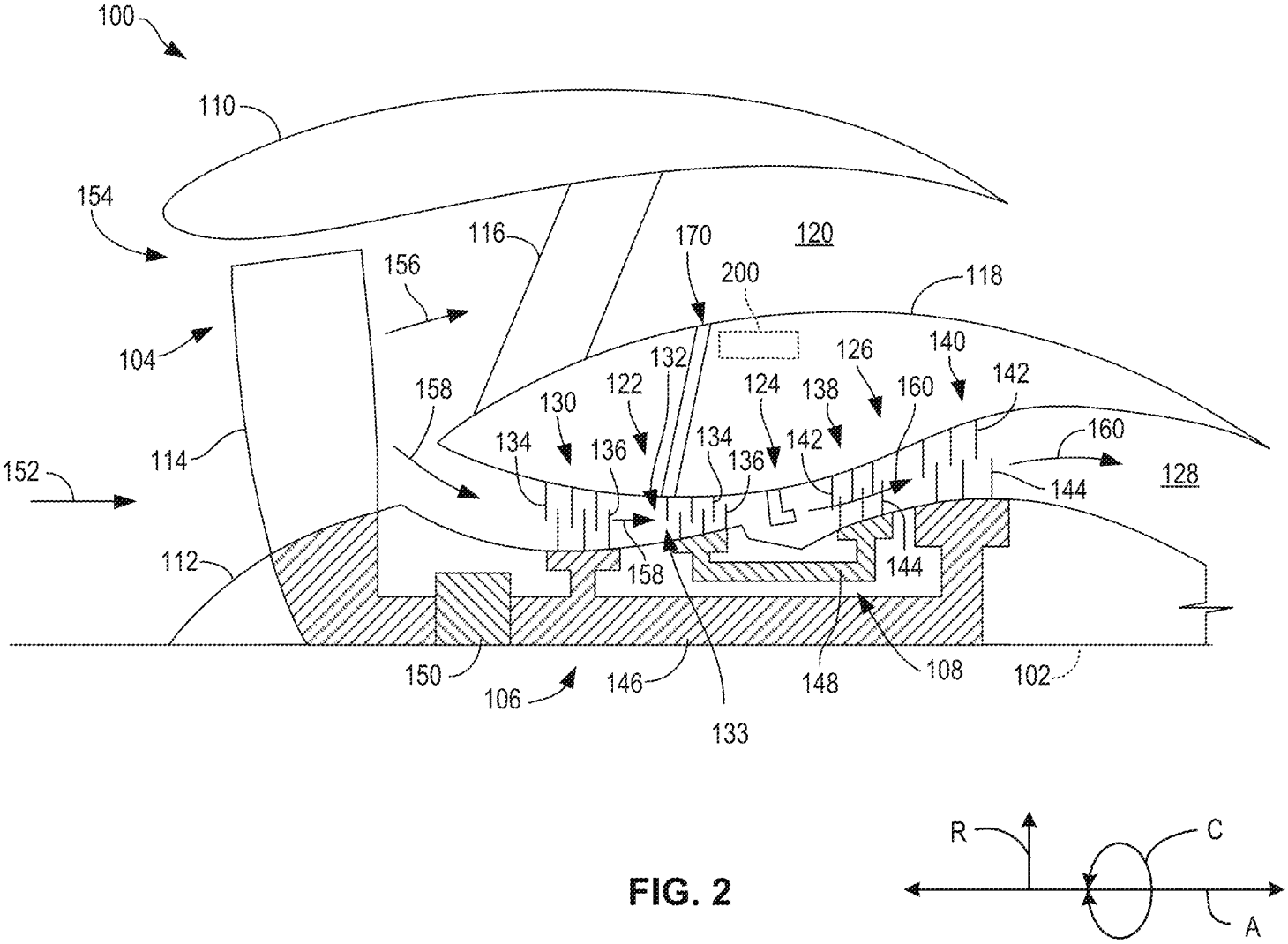
FIG. 2 is a schematic cross-sectional view of an example gas turbine engine of an aircraft.

FIG. 2 is a schematic cross-sectional view of an example gas turbine engine 100. In the illustrated example, the engine 100 is configured as a high-bypass turbofan engine. However, in alternative examples, the engine 100 may be configured as a propfan engine, a turbojet engine, a turboprop engine, a turboshaft gas turbine engine, or any other suitable type of gas turbine engine.

In general, the engine 100 extends along an axial centerline 102 and includes a fan 104, a low-pressure (LP) spool 106, and a high pressure (HP) spool 108 at least partially encased by an annular nacelle 110. More specifically, the fan 104 may include a fan rotor 112 and a plurality of fan blades 114 (one is shown) coupled to the fan rotor 112. In this respect, the fan blades 114 are circumferentially spaced apart and extend radially outward from the fan rotor 112. Moreover, the LP and HP spools 106, 108 are positioned downstream from the fan 104 along the axial centerline 102. As shown, the LP spool 106 is rotatably coupled to the fan rotor 112, thereby permitting the LP spool 106 to rotate the fan blades 114. Additionally, a plurality of outlet guide vanes or struts 116 circumferentially spaced apart from each other and extend radially between an outer casing 118 surrounding the LP and HP spools 106, 108 and the nacelle 110. As such, the struts 116 support the nacelle 110 relative to the outer casing 118 such that the outer casing 118 and the nacelle 110 define a bypass airflow passage 120 positioned therebetween.

The outer casing 118 generally surrounds or encases, in serial flow order, a compressor section 122, a combustion section 124, a turbine section 126, and an exhaust section 128. In some examples, the compressor section 122 may include a low-pressure (LP) compressor 130 of the LP spool 106 and a high-pressure (HP) compressor 132 of the HP spool 108 positioned downstream from the LP compressor 130 along the axial centerline 102. Each compressor 130, 132 may, in turn, include one or more rows of stator vanes 134 interdigitated with one or more rows of compressor rotor blades 136. As such, the compressors 130, 132 define a compressed air flow path 133 extending therethrough. Moreover, in some examples, the turbine section 126 includes a high-pressure (HP) turbine 138 of the HP spool 108 and a low-pressure (LP) turbine 140 of the LP spool 106 positioned downstream from the HP turbine 138 along the axial centerline 102. Each turbine 138, 140 may, in turn, include one or more rows of stator vanes 142 interdigitated with one or more rows of turbine rotor blades 144.

Additionally, the LP spool 106 includes the low-pressure (LP) shaft 146 and the HP spool 108 includes a high pressure (HP) shaft 148 positioned concentrically around the LP shaft 146. In such examples, the HP shaft 148 rotatably couples the turbine rotor blades 144 of the HP turbine 138 and the compressor rotor blades 136 of the HP compressor 132 such that rotation of the turbine rotor blades 144 of the HP turbine 138 rotatably drives the compressor rotor blades 136 of the HP compressor 132. As shown, the LP shaft 146 is directly coupled to the turbine rotor blades 144 of the LP turbine 140 and the compressor rotor blades 136 of the LP compressor 130. Furthermore, the LP shaft 146 is coupled to the fan 104 via a gearbox 150. In this respect, the rotation of the turbine rotor blades 144 of the LP turbine 140 rotatably drives the compressor rotor blades 136 of the LP compressor 130 and the fan blades 114.

In some examples, the engine 100 may generate thrust to propel an aircraft. More specifically, during operation, air (indicated by arrow 152) enters an inlet portion 154 of the engine 100. The fan 104 supplies a first portion (indicated by arrow 156) of the air 152 to the bypass airflow passage 120 and a second portion (indicated by arrow 158) of the air 152 to the compressor section 122. The second portion 158 of the air 152 first flows through the LP compressor 130 in which the compressor rotor blades 136 therein progressively compress the second portion 158 of the air 152. Next, the second portion 158 of the air 152 flows through the HP compressor 132 in which the compressor rotor blades 136 therein continue to progressively compress the second portion 158 of the air 152. The compressed second portion 158 of the air 152 is subsequently delivered to the combustion section 124. In the combustion section 124, the second portion 158 of the air 152 mixes with fuel and burns to generate high-temperature and high-pressure combustion gases 160. Thereafter, the combustion gases 160 flow through the HP turbine 138 which the turbine rotor blades 144 of the HP turbine 138 extract a first portion of kinetic and/or thermal energy therefrom. This energy extraction rotates the HP shaft 148, thereby driving the HP compressor 132. The combustion gases 160 then flow through the LP turbine 140 in which the turbine rotor blades 144 of the LP turbine 140 extract a second portion of kinetic and/or thermal energy therefrom. This energy extraction rotates the LP shaft 146, thereby driving the LP compressor 130 and the fan 104 via the gearbox 150. The combustion gases 160 then exit the engine 100 through the exhaust section 128.

As mentioned above, the aircraft 10 may include a thermal management system 200 for transferring heat between fluids supporting the operation of the aircraft 10. In this respect, the thermal management system 200 may be positioned within the engine 100. For example, as shown in FIG. 2, the thermal management system 200 is positioned within the outer casing 118 of the engine 100. However, in alternative examples, the thermal management system 200 may be positioned at any other suitable location within the engine 100.

Furthermore, in some examples, the engine 100 defines a third-stream flow path 170. In general, the third-stream flow path 170 extends from the compressed air flow path 133 defined by the compressor section 122 to the bypass airflow passage 120. In this respect, the third-stream flow path 170 allows a portion of the compressed air 158 from the compressor section 122 to bypass the combustion section 124. More specifically, in some examples, the third-stream flow path 170 may define a concentric or non-concentric passage relative to the compressed air flow path 170 downstream of one or more of the compressors 130, 132 or the fan 104. The third-stream flow path 170 may be configured to selectively remove a portion of compressed air 158 from the compressed air flow path 170 via one or more variable guide vanes, nozzles, or other actuable flow control structures. In addition, as will be described below, in some examples, the thermal management system 200 may transfer heat to the air flowing through the third-stream flow path 170. However, a pressure and/or a flow rate of a fluid (e.g., a heat exchange fluid such as a supercritical fluid (e.g., supercritical carbon dioxide (sCO2), etc.)) within the thermal management system 200 limits a rate at which thermal energy is transferred between the air and the heat exchange fluid. Additionally, it is advantageous for the thermal management system 200 to produce the pressure and/or the flow rate with components (e.g., pump systems) that minimize and/or otherwise reduce a physical size of the thermal management system 200 and/or the components (e.g., pump systems) included therein. Moreover, the thermal management system 200 may ensure that the heat exchange fluid is free of contaminants when thermal energy is to be transferred.

The example thermal management system 200, as described above, ensures proper operation of the aircraft 10. As such, the thermal management system 200 must be operational to support the operation of the aircraft 10. The thermal management system 200 can include a pump system to move fluid throughout the thermal management system 200 to support heat transfer functionality. Pump systems can include bearings which support the operation of the pump system. As disclosed above, failure of bearings in pump systems can occur where the bearings are subjected to excessive forces (e.g., vibration, shear, stress, etc.) beyond what the bearings are rated for, and thus, can cause failure to the pump system. Consequently, failure to the pump system can cause failure to the thermal management system 200 and, likewise, failure to the engine 100.

The configuration of the gas turbine engine 100 described above and shown in FIG. 2 is provided only to place the present subject matter in an example field of use. Thus, the present subject matter may be readily adaptable to any manner of gas turbine engine configuration, including other types of aviation-based gas turbine engines, marine-based gas turbine engines, and/or land-based/industrial gas turbine engines.

Figure 3:
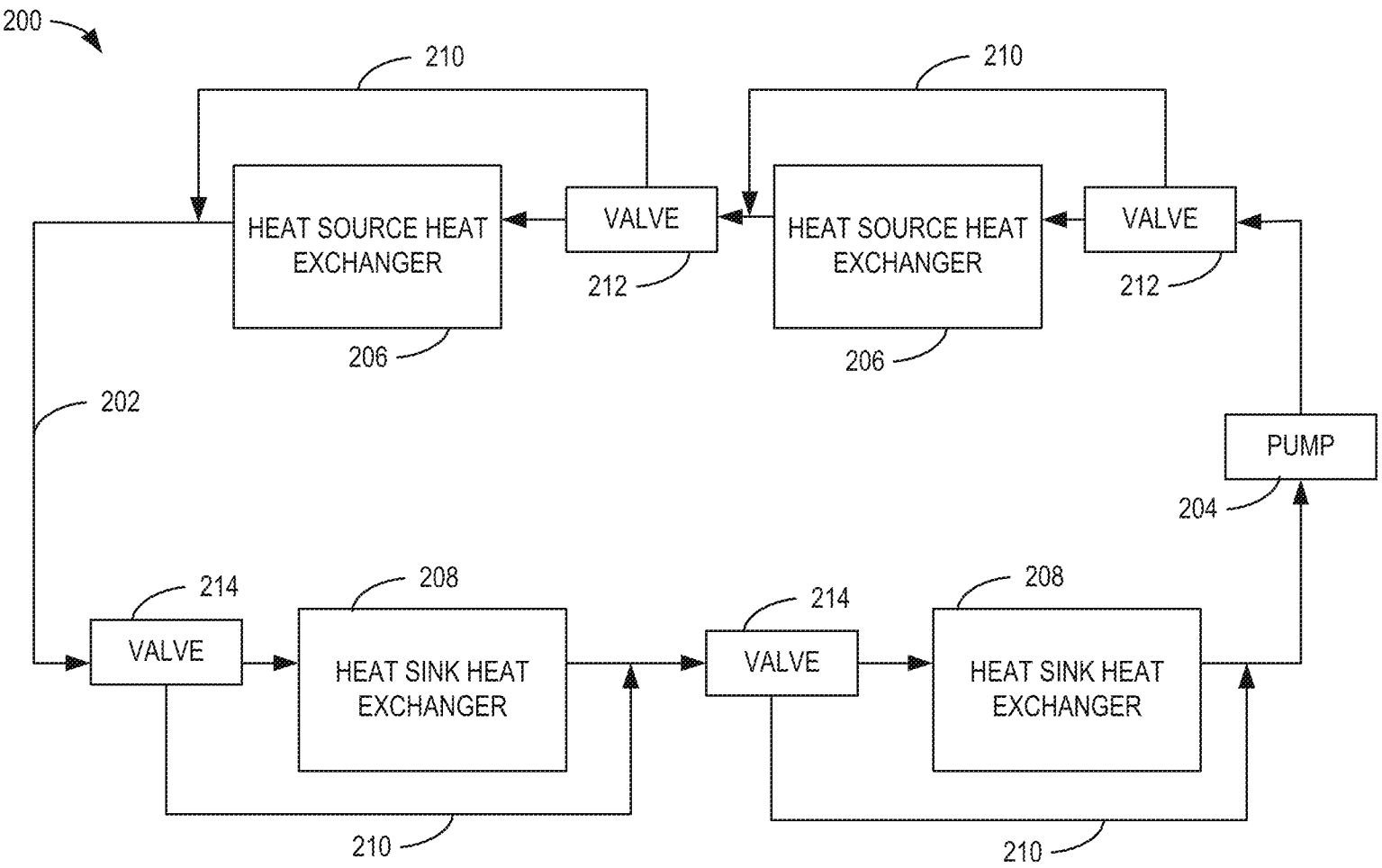
FIG. 3 is a schematic diagram of an example thermal management system for transferring heat between fluids.

FIG. 3 is a schematic view of an example implementation of the thermal management system 200 for transferring heat between fluids. In general, the thermal management system 200 will be discussed in the context of the aircraft 10 and the gas turbine engine 100 described above and shown in FIGS. 1 and 2. However, the disclosed thermal management system 200 may be implemented within other aircraft and/or any gas turbine engine configuration.

As shown, the thermal management system 200 includes a thermal transport bus 202. Specifically, in several examples, the thermal transport bus 202 is configured as one or more fluid conduits through which a fluid (e.g., a heat exchange fluid) flows. As will be described below, the heat exchange fluid flows through various heat exchangers such that heat is added to and/or removed from the heat exchange fluid. In this respect, the heat exchange fluid may be any suitable fluid, such as supercritical carbon dioxide. Moreover, in such examples, the thermal management system 200 includes a pump 204 configured to pump the heat exchange fluid through the thermal transport bus 202.

Additionally, the thermal management system 200 includes one or more heat source heat exchangers 206 arranged along the thermal transport bus 202. More specifically, the heat source heat exchanger(s) 206 is fluidly coupled to the thermal transport bus 202 such that the heat exchange fluid flows through the heat source heat exchanger(s) 206. In this respect, the heat source heat exchanger(s) 206 is configured to transfer heat from fluids supporting the operation of the aircraft 10 to the heat exchange fluid, thereby cooling the fluids supporting the operation of the aircraft 10. Thus, the heat source heat exchanger(s) 206 adds heat to the heat exchange fluid. Although FIG. 3 illustrates two heat source heat exchangers 206, the thermal management system 200 may include a single heat source heat exchanger 206 or three or more heat source heat exchangers 206.

The heat source heat exchanger(s) 206 may correspond to any suitable heat exchanger(s) that cool a fluid supporting the operation of the aircraft 10. In one example, at least one of the heat exchangers 206 is a heat exchanger(s) of the lubrication system(s) of the engine(s) 100. In such an example, this heat exchanger(s) 206 transfers heat from the oil lubricating the engine(s) 100 to the heat transfer fluid. In another example, at least one of the heat exchangers 206 is a heat exchanger(s) of the cooling system of the engine(s) 100. In such an example, this heat exchanger(s) 206 transfers heat from the cooling air bled from the compressor section(s) 122 (or a compressor discharge plenum) of the engine(s) 100 to the heat transfer fluid. However, in alternative examples, the heat source heat exchanger(s) 206 may correspond to any other suitable heat exchangers that cool a fluid supporting the operation of the aircraft 10.

Furthermore, the thermal management system 200 includes a plurality of heat sink heat exchangers 208 arranged along the thermal transport bus 202. More specifically, the heat sink heat exchangers 208 are fluidly coupled to the thermal transport bus 202 such that the heat exchange fluid flows through the heat sink heat exchangers 208. In this respect, the heat sink heat exchangers 208 are configured to transfer heat from the heat exchange fluid to other fluids supporting the operation of the aircraft 10, thereby heating the other fluids supporting the operation of the aircraft 10. Thus, the heat sink heat exchangers 208 remove heat from the heat exchange fluid. Although FIG. 3 illustrates two heat sink heat exchangers 208, the thermal management system 200 may include three or more heat sink heat exchangers 208.

The heat sink heat exchangers 208 may correspond to any suitable heat exchangers that heat a fluid supporting the operation of the aircraft 10. For example, at least of one of the heat exchangers 208 is a heat exchanger(s) of the fuel system(s) of the engine(s) 100. In such an example, the fuel system heat exchanger(s) 208 transfers heat from the heat transfer fluid to the fuel supplied to the engine(s) 100. In another embodiment, at least one of the heat exchangers 208 is a heat exchanger(s) in contact with the air 156 flowing through the bypass airflow passage(s) 120 of the engine(s) 100. In such an example, this heat exchanger(s) 208 transfers heat from the heat exchange fluid to the air 156 flowing through the bypass airflow passage(s) 120.

In several examples, one or more of the heat exchangers 208 are configured to transfer heat to the air flowing through the third-stream flow path 170. In such examples, the heat exchanger(s) 208 is in contact with the air flow through the third-stream flow path 170. Thus, heat from the heat exchange fluid flowing through the thermal transport bus 202 may be transferred to the air flow through the third-stream flow path 170. The use of the third-stream flow path 170 as a heat sink for the thermal management system 200 provides one or more technical advantages. For example, the third-stream flow path 170 provides greater cooling than other sources of bleed air because a larger volume of air flows through the third-stream flow path 170 than other bleed air flow paths. Moreover, the air flowing through third-stream flow path 170 is cooler than the air flowing through other bleed air flow paths and the compressor bleed air. Additionally, the air in the third-stream flow path 170 is pressurized, thereby allowing the heat exchanger(s) 208 to be smaller than heat exchangers relying on other heat sinks within the engine. Furthermore, in examples in which the engine 100 is unducted, using the third-stream flow path 170 as a heat sink does not increase drag on the engine 100 unlike the use of ambient air (e.g., a heat exchanger in contact with air flowing around the engine 100). However, in alternative examples, the heat sink heat exchangers 208 may correspond to any other suitable heat exchangers that heats a fluid supporting the operation of the aircraft 10.

Moreover, in several examples, the thermal management system 200 includes one or more bypass conduits 210. Specifically, as shown in the example of FIG. 3, each bypass conduit 210 is fluidly coupled to the thermal transport bus 202 such that the bypass conduit 210 allows at least a portion of the heat exchange fluid to bypass one of the heat exchangers 206, 208. In some examples, the heat exchange fluid bypasses one or more of the heat exchangers 206, 208 to adjust the temperature of the heat exchange fluid within the thermal transport bus 202. The flow of example heat exchange fluid through the bypass conduit(s) 210 is controlled to regulate the pressure of the heat exchange fluid within the thermal transport bus 202. In the illustrated example of FIG. 3, each heat exchanger 206, 208 has a corresponding bypass conduit 210. However, in alternative examples, any number of heat exchangers 206, 208 may have a corresponding bypass conduit 210 so long as there is at least one bypass conduit 210.

Additionally, in several examples, the thermal management system 200 includes one or more heat source valves 212 and one or more heat sink valves 214. In general, each heat source valve 212 is configured to control the flow of the heat exchange fluid through a bypass conduit 210 that bypasses a heat source heat exchanger 206. Similarly, each heat sink valve 214 is configured to control the flow of the heat exchange fluid through a bypass conduit 210 that bypasses a heat sink heat exchanger 208. In this respect, each valve 212, 214 is fluidly coupled to the thermal transport bus 202 and a corresponding bypass conduit 210. As such, each valve 212, 214 may be moved between fully and/or partially opened and/or closed positions to selectively occlude the flow of heat exchange through its corresponding bypass conduit 210.

The valves 212, 214 are controlled based on the pressure of the heat exchange fluid within the thermal transport bus 202. More specifically, as indicated above, in certain instances, the pressure of the heat exchange fluid flowing through the thermal transport bus 202 may fall outside of a desired pressure range. When the pressure of the heat exchange fluid is too high, the thermal management system 200 may incur accelerated wear. In this respect, when the pressure of the heat exchange fluid within the thermal transport bus 202 exceeds a maximum or otherwise increased pressure value, one or more heat source valves 212 open. In such instances, at least a portion of the heat exchange fluid flows through the bypass conduits 210 instead of the heat source heat exchanger(s) 206. Thus, less heat is added to the heat exchange fluid by the heat source heat exchanger(s) 206, thereby reducing the temperature and, thus, the pressure of the fluid. In several embodiments, the maximum pressure value is between 3800 and 4000 pounds per square inch or less. In some embodiments, the maximum pressure value is between 2700 and 2900 pounds per square inch, such as 2800 pounds per square inch. In other embodiments, the maximum pressure value is between 1300 and 1500 pounds per square inch, such as 1400 pounds per square inch. Such maximum pressure values generally prevent the thermal management system 200 from incurring accelerated wear.

In some examples, the maximum pressure value is set prior to and/or during operation based on parameters (e.g., materials utilized, pump 204 design, aircraft 10 design, gas turbine engine 100 design, heat exchange fluid, etc.) associated with the thermal management system 200. The example maximum pressure value can be adjusted relative to the pressure capacities of the thermal transport bus 202, the pump 204, the heat exchangers 206, 208, the bypass conduit(s) 210, and/or the valves 212, 214. Some examples of pump 204 architecture that influence example maximum pressure capacities are described in greater detail below.

Conversely, when the pressure of the heat exchange fluid is too low, the pump 204 may experience operability problems and increased wear. As such, when the pressure of the heat exchange fluid within the thermal transport bus falls below a minimum or otherwise reduced pressure value, one or more thermal sink valves 214 open. In such instances, at least a portion of the heat exchange fluid flows through the bypass conduits 210 instead of the heat sink heat exchangers 208. Thus, less heat is removed from the heat exchange fluid by the heat sink heat exchangers 208, thereby increasing the temperature and, thus, the pressure of the fluid. In several examples, the minimum pressure value is 1070 pounds per square inch or more. In some examples, the minimum pressure value is between 1150 and 1350 pounds per square inch, such as 1250 pounds per square inch. In other examples, the minimum pressure value is between 2400 and 2600 pounds per square inch, such as 2500 pounds per square inch. Such minimum pressure values are generally utilized when the heat exchange fluid in a supercritical state (e.g., when the heat exchange fluid is carbon dioxide).

As such, the thermal management system 200 may be configured to operate such that the pressure of the heat transport fluid is maintained with a range extending between the minimum and maximum pressure values. In some examples, the range extends from 1070 to 4000 pounds per square inch. Specifically, in one example, the range extends from 1250 to 1400 pounds per square inch. In another example, range extends from 2500 to 2800 pounds per square inch.

Accordingly, the operation of the pump 204 and the valves 212, 214 allows the disclosed thermal management system 200 to maintain the pressure of the heat exchange fluid within the thermal transport bus 202 within a specified range of values as the thermal load placed on the thermal management system 200 varies.

Furthermore, the example pump 204 drives the flow of the heat exchange fluid through the thermal management system 200. In some examples, the thermal management system 200 includes one pump 204 or multiple pumps 204 depending on the desired flow rate, delta pressure across the pump 204, and/or the kinetic energy loss of the heat exchange fluid in the thermal transport bus 202. For example, the pump 204 may increase the output pressure head to accelerate the flow of the heat exchange fluid to a first flowrate. As the heat exchange fluid passes through the thermal transport bus 202, the example kinetic energy of the heat exchange fluid dissipates due to friction, temperature variations, etc. Due to the kinetic energy losses, the heat exchange fluid decelerates to a second flow rate at some point upstream of the pump 204. If the example second flow rate is below a desired operating flow rate of the heat exchange fluid, then the pump 204 can either be of a different architecture that outputs a higher first flow rate, or one or more additional pumps 204 can be included in the thermal management system 200.

As disclosed above, the example pump 204 is important for proper functionality of the engine 100 and subsequently the aircraft 10. Failure to the pump 204 can result in increases in temperature of the fluid, insufficient pressure of the fluid, and/or insufficient fluid flow rate of the fluid moving throughout the thermal management system 200. Such failures can occur due to bearings within the pump 204 failing when the forces acting on the bearings exceed their rated thresholds. As discussed further below, examples disclosed herein provide an improved bearing design to improve the integrity, stability, and reliability of bearings used in apparatus such as the aircraft 10, engine 100, and pump 204.

The operations of some example fluid pump systems and centrifugal fluid pump systems have a rotor shaft connected directly to the impeller in a pump system without a magnetic coupling to connect the rotor/radial shaft and an impeller shaft. In some examples, a bearing is used to support a radial and/or an axial load that a rotor/radial shaft generates, respectively, during operation of the pump system. In some examples, the bearing supporting the radial load can include a foil bearing and the bearing supporting the axial load can include a thrust bearing. A foil/thrust bearing is a form of air bearing that uses a spring-loaded foil between a shaft and a journal lining to support the shaft at low startup speeds. Once the shaft is rotating at a high enough rate (depending on the architecture of the foil/thrust bearing) a working fluid (e.g., air, nitrogen, argon, etc.) is pulled into the foil/thrust bearing due to the viscosity effects of the working fluid. Thus, the working fluid pressure increases in the foil/thrust bearing, pushes the foil outward from the shaft, and supports the radial/axial load that the shaft generates creating a frictionless bearing with no liquid lubricants. Since the foil/thrust bearing does not use liquid lubricants, a hermetic sealing (e.g., a magnetic coupling) may not be used to prevent lubricants from contaminating a fluid (e.g., heat exchange fluid such as a supercritical fluid (e.g., sCO2, etc.)) that the pump system pressurizes.

In some examples, the foil/thrust bearing used to support the radial/axial load that the rotor/radial shaft produces experiences wear during the start-up, stopping, and non-operation of the pump system. More specifically, the spring-loaded foil that supports the weight of the rotor shaft at lower speeds (start-up and stopping rotational speeds) experiences damage over time due to frictional erosion. Additionally, non-operation of the pump purports the same damage possibilities where the aircraft 10 may cause vibration to the pump system while the aircraft 10 is in operation, causing the rotor/radial shafts to damage the foil/thrust bearings. In the examples disclosed herein, a deformation limiter is disposed in the foil/thrust bearing to limit deformation of the spring-loaded foil during start-up, stopping, and non-operation of the pump system. Thus, the examples disclosed herein limit a radial/axial deformation that the foil/thrust bearing may experience during start-up, stopping, and non-operation of the pump system and reduce damage to the foil/thrust bearings to increase the lifespan (e.g., usable life) of the foil/thrust bearings.

Figure 4:
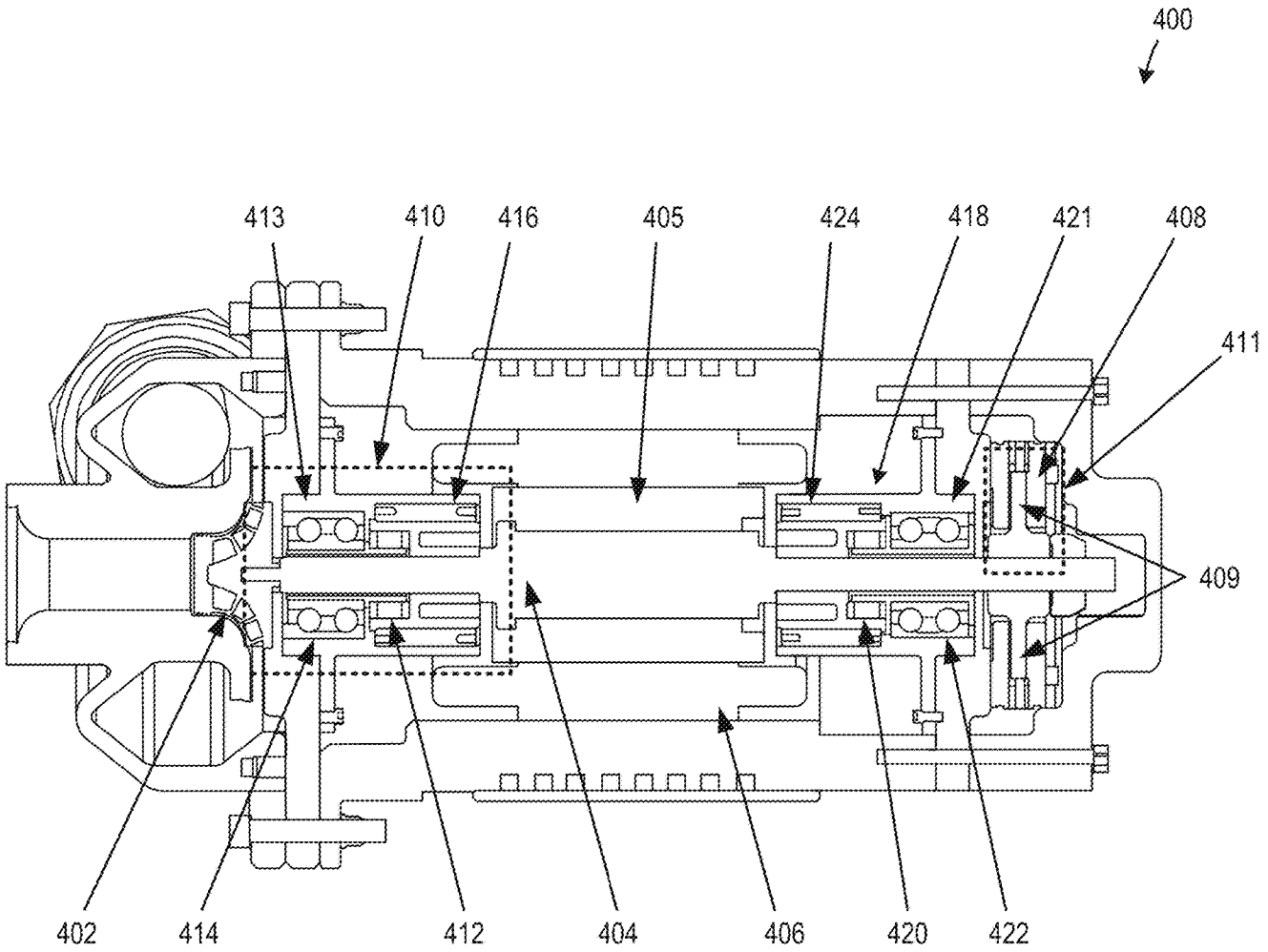
FIG. 4 illustrates example integrated bearing systems for dynamically supporting a rotating shaft in an example pump system in accordance with the teachings of this disclosure.

FIG. 4 illustrates a cross-sectional view of a pump system 400 for pressurizing fluid (e.g., a heat exchange fluid such as a supercritical fluid (e.g., sCO2, etc.)) in a system (e.g., thermal management system 200 of FIG. 3). In some examples, the pump system 400 is used to pump sCO2 through a thermal management system on an aircraft (e.g., aircraft 10 of FIG. 1) and/or a gas turbine engine (e.g., gas turbine engine 100 of FIG. 2). As shown in FIG. 4, the pump system 400 includes an impeller 402, a rotor shaft 404, a rotor 405, a stator 406, a thrust bearing 408, radial shafts 409, a first integrated bearing system 410, a thrust bearing assembly 411, a first sprag clutch 412, a first bearing housing 413, a first rolling-element bearing 414, a first foil bearing 416, a second integrated bearing system 418, a second sprag clutch 420, a second bearing housing 421, a second rolling-element bearing 422, and a second foil bearing 424.

The example pump system 400 illustrated in FIG. 4 includes the impeller 402 to pressurize the fluid (e.g., sCO2) in the system (e.g., the thermal management system 200 of FIG. 3). The example impeller 402 is a component of the pump system 400 that is connected to the rotor shaft 404 and rotates at a same rotational speed as the rotor shaft 404. In some examples, the impeller 402 is same as or similar to impellers used in centrifugal pumps and includes vanes and/or blades to deflect flow of the incoming fluid radially outward into outlet flowlines. The example impeller 402 converts mechanical power of a motor (e.g., the rotor shaft 404 and the stator 406) into hydrodynamic power of the fluid flow.

The example pump system 400 illustrated in FIG. 4 includes the stator 406 to apply a torque on the rotor 405, which is coupled to the rotor shaft 404. Since the example rotor 405 is connected to the rotor shaft 404 (e.g., via bolts, adhesives, interference fit, etc.), the stator 406 causes the rotor shaft 404 to rotate while the stator 406 remains stationary. The example stator 406, the example rotor 405, and the example rotor shaft 404 are included as parts of an example electric motor and/or the engine 100. In some examples, the stator 406 includes field magnets (e.g., electromagnets or permanent magnets) that generate magnetic field(s) based on an electric current (e.g., direct current or alternating current) passing through various the electromagnets of the stator 406. The example stator 406 generates a first set of magnetic fields that apply a force (e.g., Lorentz force) on a second set of magnetic fields that the rotor 405 generates. The example rotor 405 generates the second set of magnetic fields via permanent magnets and/or electromagnets. Since the example stator 406 is stationary (e.g., fixed in place), the force causes the example rotor 405 to rotate and to produce a torque. Since the example rotor shaft 404 is connected to the example rotor 405, the rotor shaft 404 produces the same torque and rotates at a same angular velocity as the rotor 405.

The example thrust bearing assembly 411 illustrated in FIG. 4 includes the thrust bearing 408 to support a thrust load (axial load) that the rotor shaft 404 generates during operation. The example thrust bearing 408 illustrated in FIG. 4 is further described below in reference to FIGS. 8 and 9. The example rotor shaft 404 is connected to two or more radial shafts 409 that are positioned perpendicular to the axis of rotation of the rotor shaft 404. In some examples, the radial shafts 409 are connected to the rotor shaft via bolts, adhesives, interference fits, etc. The example pump system 400 illustrated in FIG. 4 includes two radial shafts 409. However, more radial shafts 409 may be connected to the rotor shaft 404. In some examples, the thrust bearing 408 includes an inner lining that interfaces with the radial shafts 409 and the spring-loaded foil. In some examples, the radial shafts 409 is a disk that is connected to the rotor shaft 404 and interacts directly with the spring-loaded foil of the thrust bearing 408.

The example pump system 400 of FIG. 4 includes the first integrated bearing system 410 to support the radial loads of the rotor shaft 404 during operation of the pump system 400. The example first integrated bearing system 410 includes the first sprag clutch 412, the bearing housing 413, the first rolling-element bearing 414, and the first foil bearing 416. The example pump system 400 of FIG. 4 also includes the second integrated bearing system 418 to similarly support the radial loads of the rotor shaft 404. The second integrated bearing system 418 includes the second sprag clutch 420, the second rolling-element bearing 422, and the second foil bearing 424. In some examples, the pump system 400 includes one integrated bearing system. In some examples, the pump system 400 includes one or more integrated bearing systems. The example first integrated bearing system 410 and the example second integrated bearing system 418 of the example pump system 400 illustrated in FIG. 4 are substantially similar. Thus, references and descriptions regarding the first integrated bearing system 410 ("bearing system 410"), the first sprag clutch 412 ("sprag clutch 412"), the first bearing housing 413 ("bearing housing 413"), the first rolling-element bearing 414 ("rolling-element bearing 414"), and the first foil bearing 416 ("foil bearing 416") can also be applied to the second integrated bearing system 418, the second sprag clutch 420, the second bearing housing 421, the second rolling-element bearing 422, and the second foil bearing 424, respectively.

The example pump system 400 illustrated in FIG. 4 includes the sprag clutch 412 to engage and disengage the rolling-element bearing 414 and the foil bearing 416 from one another during operation of the pump system 400. The example sprag clutch 412 is a disengaging-type sprag clutch that resembles a rolling-element bearing but includes non-revolving asymmetric sprag elements instead of revolving symmetric cylinders, spheres, etc. The example sprag clutch 412 includes an inner race and an outer race between which the sprag elements fit in place. The example sprag clutch 412 also includes a spring ribbon to produce a pre-loaded spring force on the sprag elements to engage the sprag clutch with the inner race and the outer race during non-operation. Due to the asymmetric figure-eight shaped geometry of the sprag elements, when the sprag elements rotate and wedge between the outer race and the inner race, the friction force that occurs between the components of the sprag clutch 412 cause the inner race to rotate at the same angular velocity as the outer race. When the example sprag clutch 412, inner race, and outer race rotate at a first operational speed range, the sprag elements of the sprag clutch 412 remain engaged with the outer race and the inner race due to the pre-loaded spring force and a resulting spring moment. When the example sprag clutch 412, inner race, and outer race rotate at a second operational speed range, the sprag elements of the sprag clutch 412 become disengaged with the outer race and the inner race due to a centrifugal force and resulting centrifugal moment counteracting and surpassing the spring moment. Further descriptions of the example sprag clutch 412 and the operations thereof are provided below.

The example pump system 400 illustrated in FIG. 4 includes the rolling-element bearing 414 to support the radial load of the rotor shaft 404 at the first operational speed range. Some examples of the first operational speed range include a first tangential speed range of the rotor shaft 404 and/or the foil bearing 416 from 0 m/s to 50 m/s, a first fluid flow speed range exiting the pump system 400 from 0 m/s to 10 m/s, etc. The example rolling-element bearing 414 includes an inner race, an outer race, and rolling elements (e.g., balls, spheres, cylinders, etc.). The inner race and outer race of the example rolling-element bearing 414 are able to rotate freely in either direction. In some examples, the rolling-element bearing 414 includes liquid lubricant (e.g., oil, grease, etc.) to reduce the friction forces within the rolling-element bearing 414 and increase the lifespan of the rolling-element bearing 414. If the example pump system 400 uses liquid lubricants for the rolling-element bearing 414, then an example oil separator may be included in the pump system 400 to help ensure the fluid does not get contaminated. Some examples of oil separators that can be utilized in the examples disclosed herein are described in further detail below. In some examples, the rolling-element bearing 414 includes an inorganic grease (e.g., silicone grease, bentonite clay, polyurea, etc.) as a lubricant. The example rolling-element bearing 414 illustrated in FIG. 4 uses a solid lubricant (e.g., silver coating, graphite, molybdenum disulfide, etc.) to reduce friction in the rolling-element bearing 414 and to increase the lifespan of the rolling-element bearing 414 while removing the risk of contaminating the fluid with liquid lubricants. The rolling-element bearing 414 can be one of many types of rolling-element bearings familiar to those with skill in the art, such as cylindrical rolling-element bearings, angular contact ball bearings, hybrid ceramic bearings, tapered rolling-element bearings, deep groove single ball bearings, duplex ball bearings, spherical ball bearings, or any combination thereof. In some examples, the rolling-element bearing 414 is hermetically sealed from the example fluid via one or more hermetic seals (e.g., piston seals, epoxy seal, ceramic-to-metal seal, etc.). The example rolling-element bearing 414 may have a lifespan of 1000 hours or more depending on the type of rolling-element bearing, the type of lubricant, and/or the effectiveness of the hermetic sealing. In some examples, the rolling-element bearing 414 is externally cooled via conductive heat exchange from the rolling-element bearing 414 to fuel, oil, air, and/or the thermal transport bus 202 of FIG. 2. Additionally or alternatively, an evaporative cooling system may be used to cool the example rolling-element bearing 414.

The example pump system 400 illustrated in FIG. 4 includes the foil bearing 416 to support the radial load of the rotor shaft 404 at the second operational speed range. Some examples of the second operational speed range include a second tangential speed range of the rotor shaft 404 and/or the foil bearing 416 from 50 m/s to 200 m/s, a second fluid flow speed range exiting the pump system 400 from 10 m/s to 100 m/s, etc. The example foil bearing 416 is further described in reference to FIGS. 6 and 7 below. The example foil bearing 416, the example rolling-element bearing 414, the example sprag clutch 412, and, in general, the example integrated bearing system 410 are described in greater detail below.

The example pump system 400 illustrated in FIG. 4 includes the bearing housing 413 to support the rolling-element bearing 414 and the foil bearing 416. In some examples, the bearing housing 413 is an additively manufactured part that is designed to fit dimensions of the rolling-element bearing 414 and the foil bearing 416. In some examples, the bearing housing 413 is fabricated via subtractive manufacturing to fit dimensions of the rolling-element bearing 414 and the foil bearing 416. In some examples, the bearing housing 413 securely supports the rolling-element bearing 414 and the foil bearing 416 via bolts, dowels, pins, adhesives, and/or interference fits.

Figure 5:
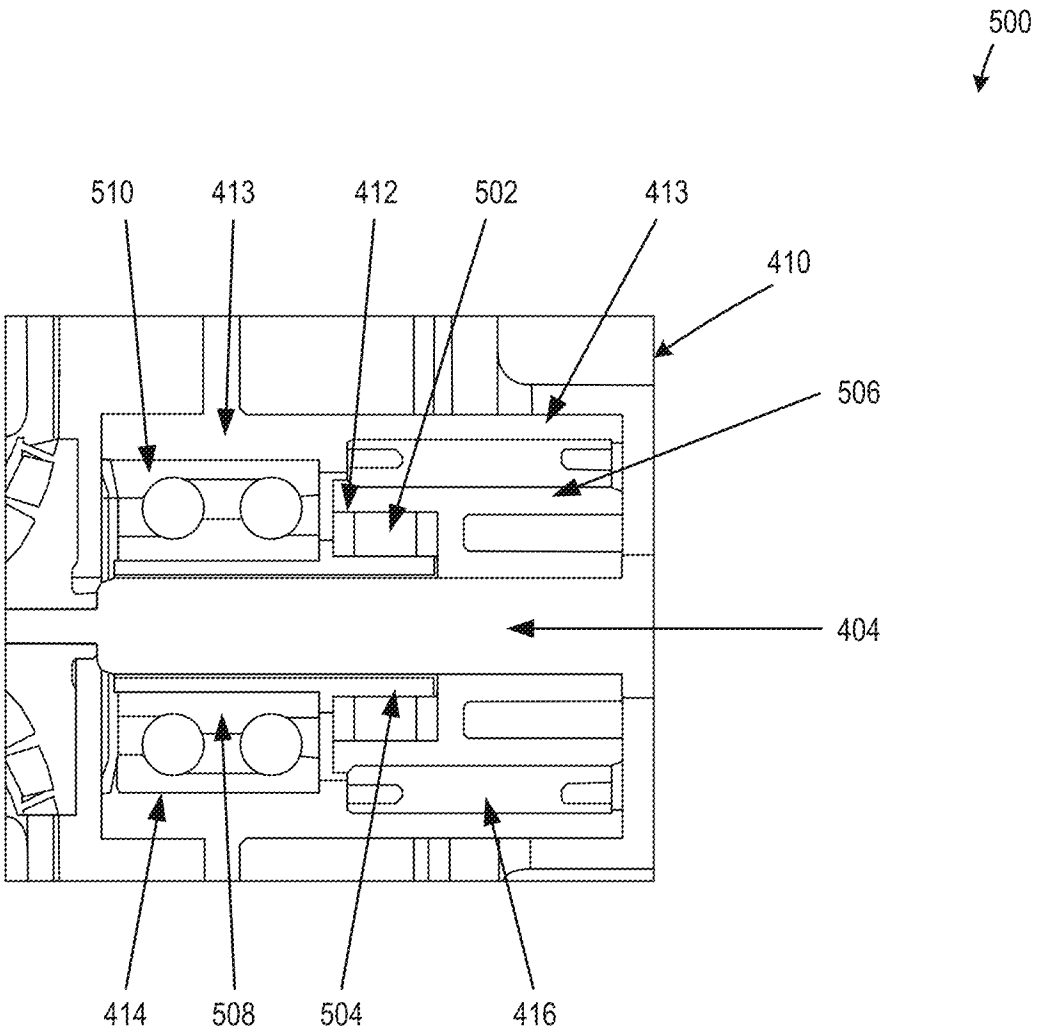
FIG. 5 illustrates an example integrated bearing system for dynamically supporting the rotating shaft in the example pump system in accordance with the teachings of this disclosure.

FIG. 5 illustrates an enlarged view 500 of the example integrated bearing system 410 of the pump system 400 for supporting radial loads that the rotor shaft 404 generates during operation of the pump system 400. As shown in FIG. 5, the enlarged view 500 includes the rotor shaft 404, the integrated bearing system 410, the sprag clutch 412, the bearing housing 413, the rolling-element bearing 414, the foil bearing 416, sprag elements 502, a first inner race 504, a first outer race 506, a second inner race 508, and a second outer race 510. As mentioned earlier, the example components of the integrated bearing system 410 illustrated in FIG. 5 can be included in the example second integrated bearing system 418 illustrated in FIG. 4. The example enlarged view 500 of FIG. 5 illustrates the rotor shaft 404, the integrated bearing system 410, the sprag clutch 412, the bearing housing 413, the rolling-element bearing 414, and the foil bearing 416 as previously described in reference to FIG. 4.

The example integrated bearing system 410 as illustrated in FIG. 5 includes the sprag elements 502 to engage the first inner race 504 and the first outer race 506 such that the first inner race 504 and the first outer race 506 rotate simultaneously and with the same torque output. Although two sprag elements 502 are illustrated in FIG. 5, the example integrated bearing system 410 can include two or more sprag elements 502. As mentioned previously, the example sprag elements 502 are asymmetrically shaped such that when the sprag elements 502 rotate about an axis of rotation in a first direction, the sprag elements wedge between the first inner race 504 and the first outer race 506 and create friction forces between the components. The friction forces that the example sprag elements 502 create occur between the sprag elements 502 and the first inner race 504 as well as between the sprag elements 502 and the first outer race 506. The friction forces that the sprag elements 502 create cause the first inner race 504 and the first outer race 506 to rotate at a same angular velocity. As mentioned previously, the asymmetric shape of the sprag elements 502 also allow the first inner race 504 and the first outer race 506 to rotate freely in either direction when the sprag elements 502 rotate about the axis of rotation in a second direction opposite from the first direction. The sprag elements 502 and the operations thereof are described in greater detail below.

The example integrated bearing system 410 as illustrated in FIG. 5 includes the first inner race 504 to engage with the sprag elements 502 and the rolling-element bearing 414 at the first operational speed range (e.g., tangential speed range of the rotor shaft 404 and/or the foil bearing 416 from 0 m/s to 50 m/s, fluid flow speed range exiting the pump system 400 from 0 m/s to 10 m/s, etc.). The example first inner race 504 illustrated in FIG. 5 is a hollow shaft that envelops the rotor shaft 404 and is connected to the second inner race 508 of the rolling-element bearing 414 via bolts, adhesives, interference fits, etc. In some examples, the first inner race 504 is manufactured (e.g., subtractive machining or additive manufacturing) as the same part as the second inner race 508. The example first inner race 504 is longer than the second inner race 508 and the second outer race 510 such that the first inner race 504 interfaces with the second inner race 508 and the sprag elements 502.

The example integrated bearing system 410 as illustrated in FIG. 5 includes the first outer race 506 to engage with the sprag elements 502 and the foil bearing 416 at the second operational speed range (e.g., tangential speed range of the rotor shaft 404 and/or the foil bearing 416 from 50 m/s to 200 m/s, fluid flow speed range exiting the pump system 400 from 10 m/s to 100 m/s, etc.). The example first outer race 506 illustrated in FIG. 5 is a shaft that is connected to the rotor shaft 404 via bolts, adhesives, interference fits, etc. In some examples, the first outer race 506 is manufactured (e.g., subtractive machining or additive manufacturing) as the same part as the rotor shaft 404. The example first outer race 506 is designed such that the first outer race 506 interfaces with the sprag elements 502 and the inner lining of the example foil bearing 416.

Figure 6:
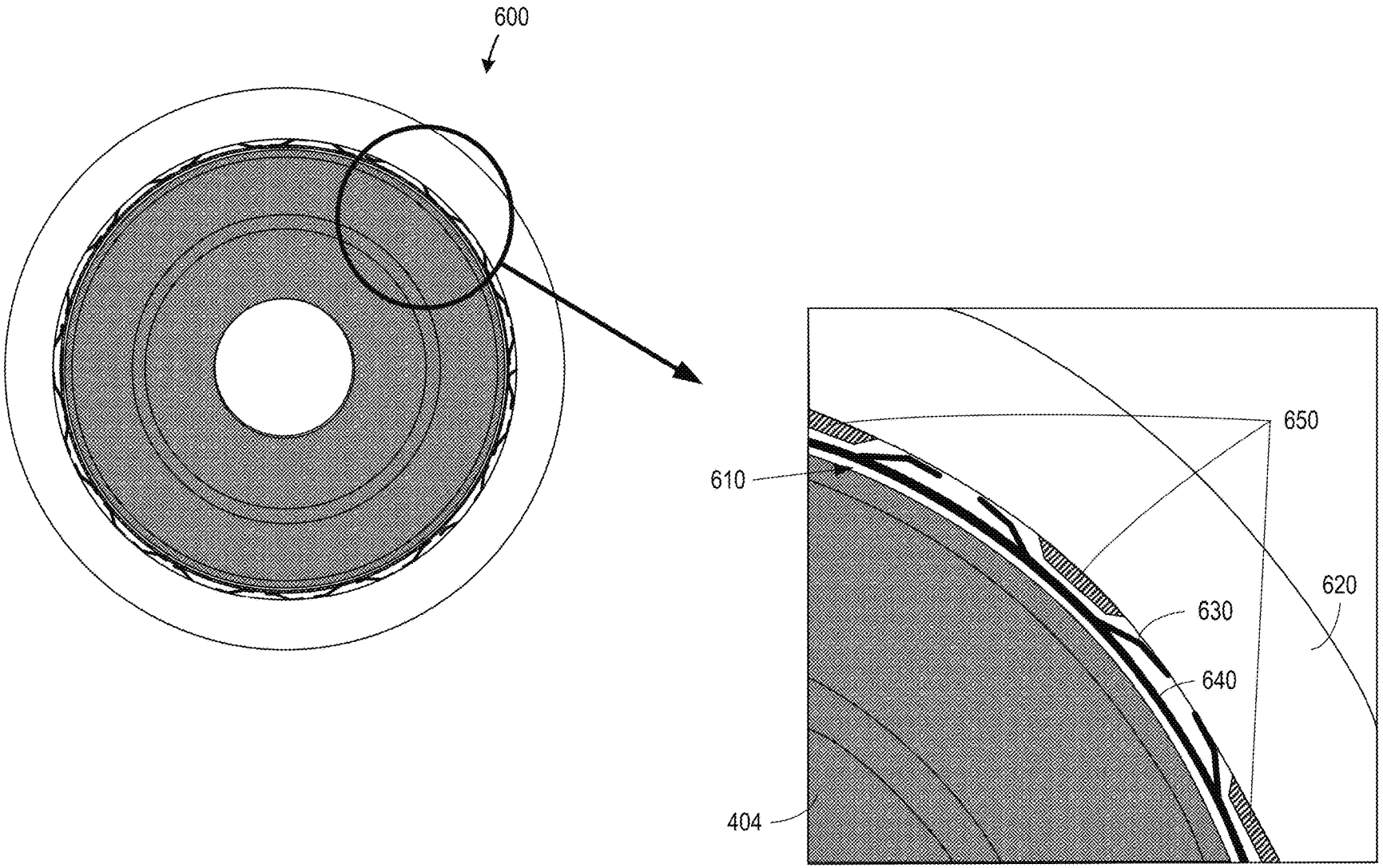
FIG. 6 illustrates a first example foil bearing used in the fluid pump system of FIGS. 4 and/or 5.

FIG. 6 illustrates a first example foil bearing 600 which can be used in the pump system 400 of FIG. 4. The first example foil bearing 600 can be used in place of the foil bearing 416 in the pump system 400 of FIG. 4. The first example foil bearing 600 includes a fluid pocket 610, a journal lining 620, a spring-loaded foil 630, an inner lining 640, and a deformation limiter 650. The spring-loaded foil 630 is coupled to the journal lining 620, where the spring-loaded foil 630 is disposed between the inner lining 640 and the journal lining 620.

The fluid pocket 610 is a pocket of pressurized fluid (e.g., compressed air) to create a non-contact barrier between the rotor shaft 404 and the inner lining 640. In some examples, the fluid pocket 610 can be filled with pressurized fluid from the pump system 400 of FIG. 4. When there is no fluid or not enough fluid to support the load of the rotor shaft 404, the rotor shaft 404 can contact the inner lining 640 directly, increasing the risk of damage to the foil bearing 416.

The journal lining 620 is a structural backing member that couples with the spring-loaded foil 630. In the examples disclosed herein, the journal lining 620 is supported by the bearing housing 413, 421 inside the pump system 400. As illustrated by the first example foil bearing 600 of FIG. 6, in some examples, the deformation limiter 650 is coupled to the journal lining 620. In such an example, the deformation limiter 650 may be manufactured with the journal lining 620 and made of the same material as the journal lining 620 (e.g., such as steel or any other suitable material for the operating conditions of the foil bearing 416).

The spring-loaded foil 630 is a structural member extending outward from the journal lining 620 to provide a dampening to a radial load. In some examples, the spring-loaded foil 630 provides the dampening to the radial load applied by the rotor shaft 404. When the pump system 400 is in operation at high speeds, the fluid pocket 610 protects the spring-loaded foil 630 from deforming (e.g., plastically deforming). As noted above, when not in operation or at low speeds, the rotor shaft 404 can apply a radial load to the foil bearing 416. The spring-loaded foil 630 provides a spring dampening to the load applied by the rotor shaft 404 to prevent damage to the journal lining 620, and consequently, the pump system 400. In some examples, the spring-loaded foil 630 implements means for dampening a load applied by the rotor shaft 404 to the first example foil bearing 600.

The inner lining 640 is displaced between the spring-loaded foil 630 and the rotor shaft 404. In some examples, the inner lining 640 includes a friction-less coating to reduce friction caused by the pressurized fluid in the fluid pocket 610. Such an example coating may include Teflon™ or any other suitable friction-less/low-friction coating. The inner lining 640 provides a buffer surface between the spring-loaded foil 630 and the rotor shaft 404. In some examples, the inner lining 640 provides an evenly distributed load to the spring-loaded foil 630 when the rotor shaft 404 is applying a radial load. In the examples disclosed herein, inner lining 640 and journal lining 620 of the foil bearing 416 are able to rotate freely in either direction. In some examples, the inner lining 640 implements means for separating a rotor shaft 404 from the spring-loaded foil 630.

In the illustrated example of FIG. 6, the deformation limiter 650 is coupled to/manufactured with the journal lining 620. When a radial load is applied to the spring-loaded foil 630, the deformation limiter 650 defines a maximum plastic deformation in which the spring-loaded foil 630 may be deformed (e.g., a structural maximum amount of deformation). The use of the deformation limiter 650 prevents damage to the journal lining 620, and consequently the pump system 400, by eliminating the possibility of the rotor shaft 404 directly contacting the journal lining 620. In some examples, the deformation limiter 650 implements means for reducing a deformation to the spring-loaded foil 630.

In the examples disclosed herein, the deformation limiter 650 may be sized per a parameterization function, such that a size of the deformation limiter 650 can be obtained by evaluating a maximum amount of radial deformation allowable, a minimum clearance that needs to be maintained between the spring-loaded foil 630 and the deformation limiter 650 (or, more generally, a minimum clearance between the rotor shaft 404 and the journal lining 620), a maximum load applied by the rotor shaft 404, or any other list of suitable parameters. For example, the parameterization function can characterize one or more rotating regions within the pump such that a maximum amount of allowable radial deformation prevents clearance closure and rubbing at the impeller and/or seals, etc. In some examples, the parameterization function may be an exponential expansion of the desired size of the deformation limiter 650 based upon the changes to any one of or combination of parameters, such as the parameters listed above. In other examples, a polynomial function may be used to characterize each parameter and determine the size of the deformation limiter 650. As such, the size, shape, and location of the deformation limiter 650 is not limited to the examples disclosed herein. The deformation limiter 650 can be used on various other types of bearings within a pump system and within other systems.

Figure 7:
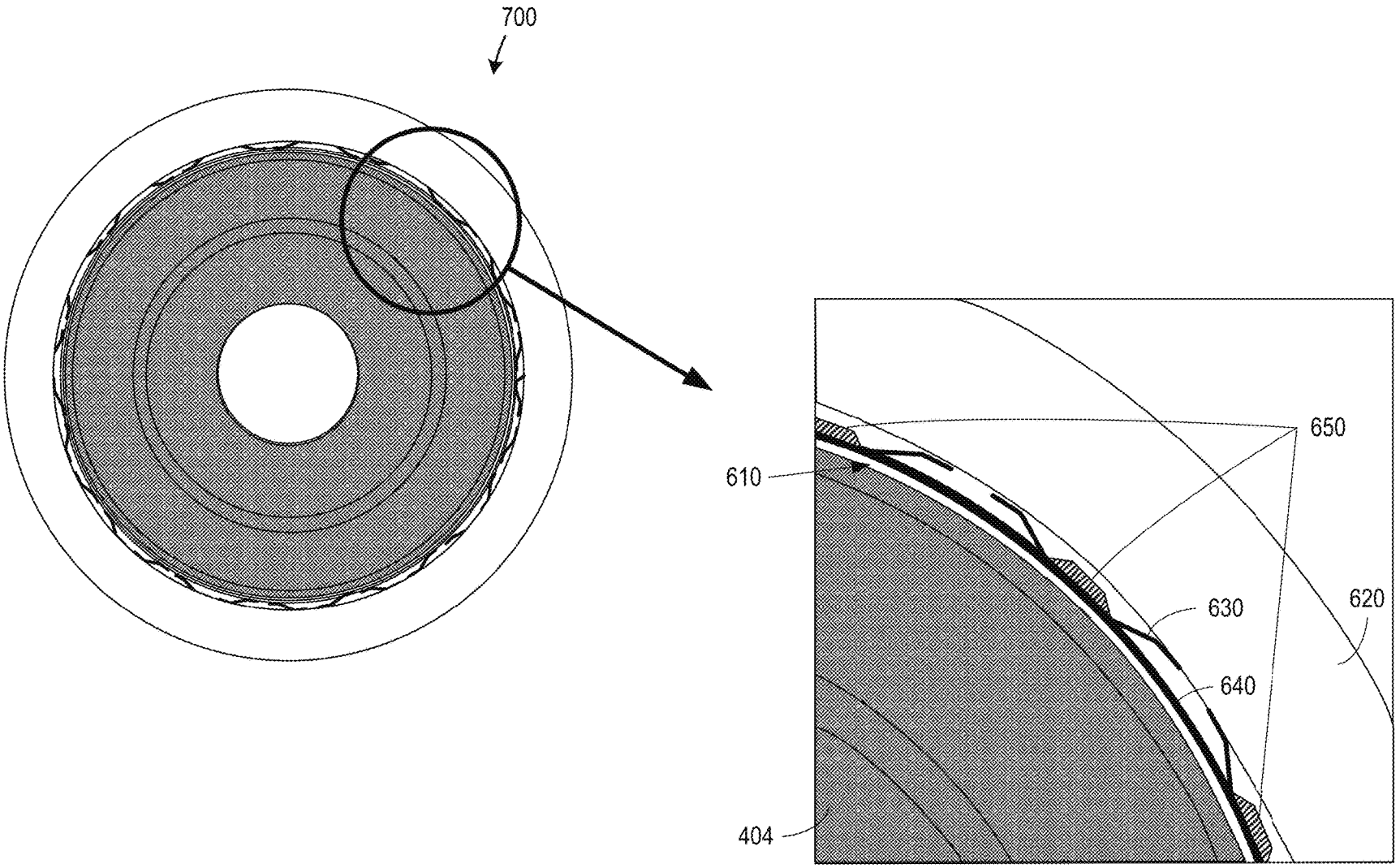
FIG. 7 illustrates a second example foil bearing used in the fluid pump system of FIGS. 4 and/or 5.

FIG. 7 illustrates a second example foil bearing 700 which can be used in the pump system 400 of FIG. 4. The second example foil bearing 700 can be used in place of the foil bearing 416 in the pump system 400 of FIG. 4. The second example foil bearing 700 includes the same components as the first example foil bearing 600 (e.g., the fluid pocket 610, the journal lining 620, the spring-loaded foil 630, the inner lining 640, and the deformation limiter 650). In the second example foil bearing 700, the deformation limiter 650 is disposed on the spring-loaded foil 630. The deformation limiter 650 of the second example foil bearing 700 of FIG. 7 performs the same function as the deformation limiter 650 of the first example foil bearing 600 of FIG. 6.

As illustrated in FIG. 7, the disposition of the deformation limiter 650 on the spring-loaded foil 630 instead of the journal lining 620 may be desired. In such an example, the spring-loaded foil 630 may require additional structural integrity to function properly, which the deformation limiter 650 can provide. In other examples, it may be cheaper to manufacture the deformation limiter 650 with the spring-loaded foil 630 while still maintaining the same amount of protection to the pump system 400. In yet another example, the deformation limiter 650 being disposed on the spring-loaded foil 630 may provide easier maintainability and/or replacement should the second example foil bearing 700 require replacement.

In operation, the first example foil bearing 600 and the second example foil bearing 700 operate similarly to react to forces applied by the aircraft 10 and/or the pump system 400. As a force (e.g., the radial load) is applied to the first and second foil bearing 500, 600, the deformation limiter 650 limits the deformation (e.g., plastic deformation) of the spring-loaded foil 630. The size, shape, material, etc. of the deformation limiter 650 produce a maximum deformation of the spring-loaded foil 630 by stopping the spring-loaded foil 630 from deforming once the deformation limiter 650 is in contact with both the spring-loaded foil 630 and the journal lining 620.

Figure 8:
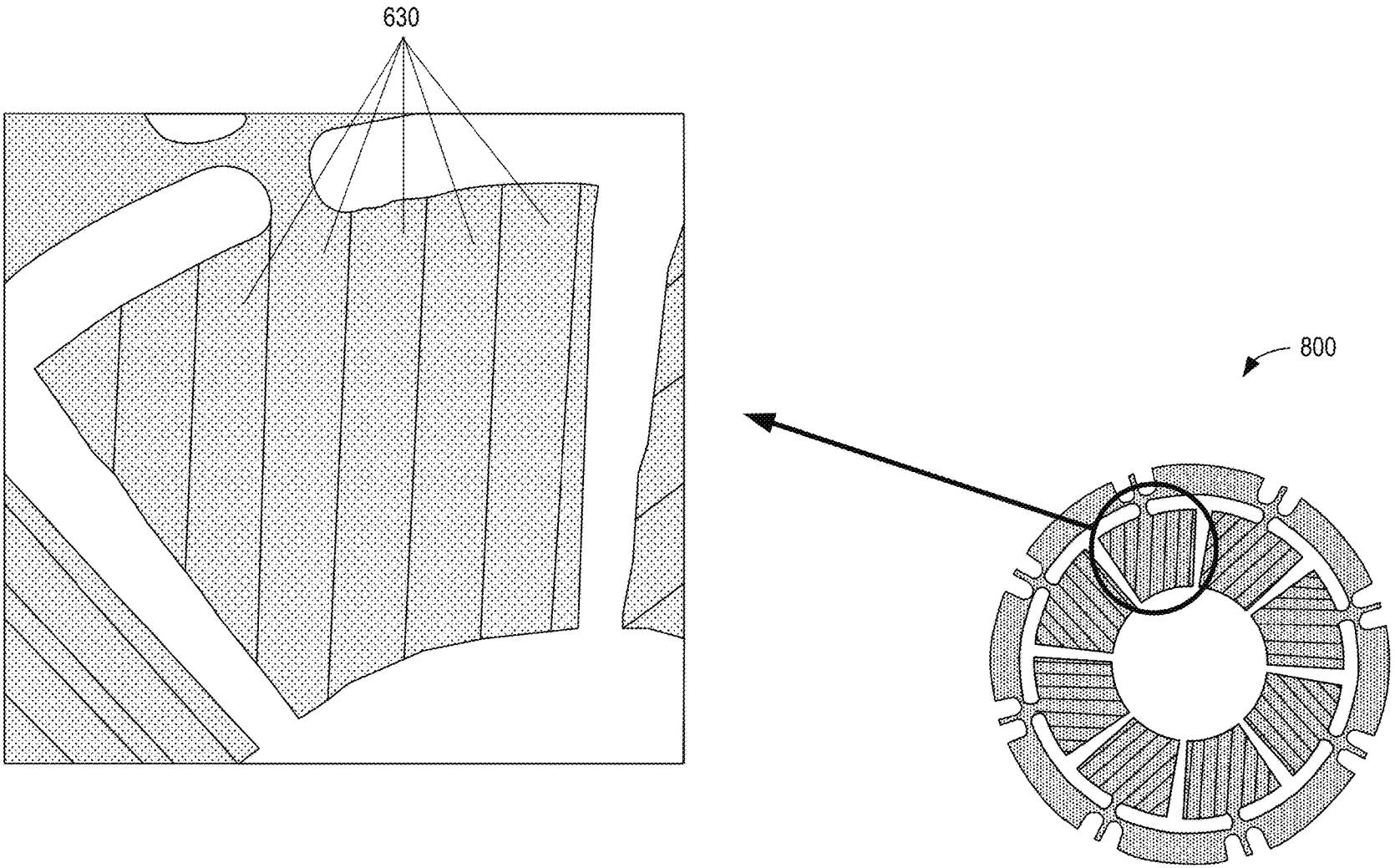
FIG. 8 illustrates an example thrust bearing used in the fluid pump system of FIGS. 4 and/or 5.

FIG. 8 illustrates an example thrust bearing 800 which can be used in the pump system 400. The example thrust bearing 800 can be used within the thrust bearing assembly 411 of the pump system 400 of FIG. 4. The example thrust bearing 800 supports the thrust load (axial load) that the rotor shaft 404 generates during operation, which is applied to the thrust bearing 408 via the radial shaft 409. The example thrust bearing 800 includes a plurality of spring-loaded foils 630.

As the aircraft 10, engine 100, pump system 200, or any other system in which bearings are used, multiple loads may be applied to the system (e.g., aerodynamic forces, vibrations, shear, stress, etc.). As such, bearings need to be placed in the system to protect the components of the system from damage due to those varying forces. As discussed below in reference to FIG. 9, the example thrust bearing 800 provides a dampening to an axial force. In the examples disclosed herein, the example thrust bearing 800 provides a dampening to the axial force applied by the radial shaft 409.

In operation, as a force (e.g., the axial load) is applied to the example thrust bearing 800, the deformation limiter 650 limits the deformation (e.g., plastic deformation) of the spring-loaded foil 630. The size, shape, material, etc. of the deformation limiter 650 produce a maximum deformation of the spring-loaded foil 630 by stopping the spring-loaded foil 630 from deforming once the deformation limiter 650 is in contact with both the spring-loaded foil 630 and the journal lining 620.

Figure 9:
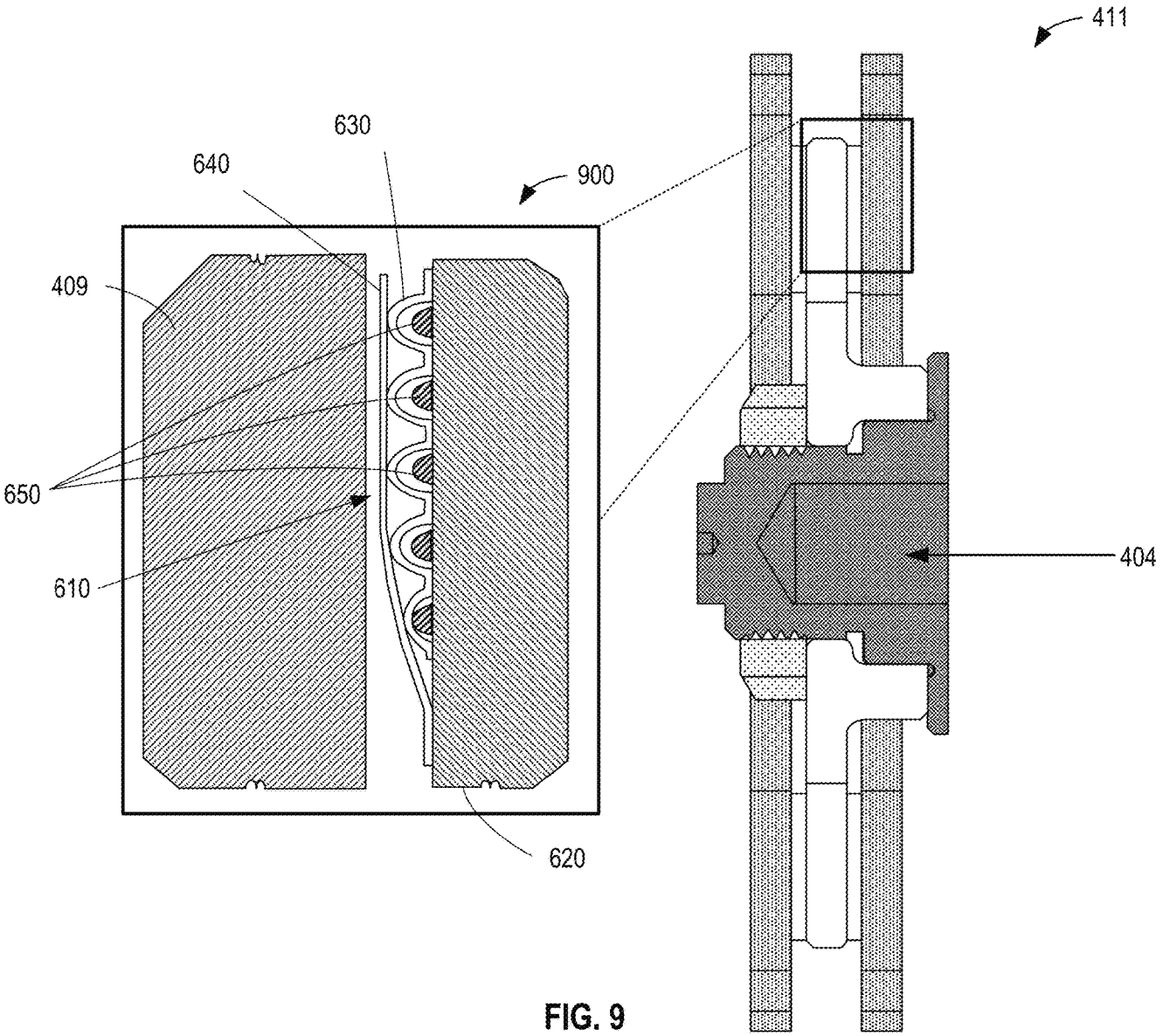
FIG. 9 illustrates an enlarged view of a thrust bearing assembly using the thrust bearing of FIG. 8.

FIG. 9 illustrates an enlarged view of the thrust bearing assembly 411 of FIG. 4. In the illustrated example of FIG. 9, the example thrust bearing 800 can be interchangeably used in place of the thrust bearing 408 within the thrust bearing assembly 411 of the pump system 400 of FIG. 4. The enlarged view 900 includes the fluid pocket 610, the journal lining 620, the spring-loaded foil 630, the inner lining 640, and the deformation limiter 650. The spring-loaded foil 630 is coupled to the journal lining 620 and the inner lining 640 is coupled to the journal lining 620 and extends over the spring-loaded foil 630.

The fluid pocket 610 of FIG. 9, similar to the fluid pocket 610 of FIG. 6, is a pocket of pressurized fluid to create a non-contact barrier between the radial shaft 409 and the inner lining 640. In some examples, the fluid pocket 610 can be filled with pressurized fluid from the pump system 400 of FIG. 4. When there is no fluid or not enough fluid to support the load of the radial shaft 409, the radial shaft 409 can contact the inner lining 640 directly, increasing the risk of damage to the thrust bearing 408

The journal lining 620 of FIG. 9, similar to the journal lining 620 of FIG. 6, is a structural backing member that couples with the spring-loaded foil 630. As illustrated in FIG. 9, the deformation limiter 650 is coupled to the journal lining 620. In such an example, the deformation limiter 650 may be manufactured with the journal lining 620 and made of the same material as the journal lining 620 (e.g., such as steel or any other suitable material for the operating conditions of the thrust bearing 408).

The spring-loaded foil 630 of FIG. 9, similar to the spring-loaded foil 630 of FIG. 6, is a structural member extending outward from the journal lining 620 to provide a dampening to an axial load. In some examples, the spring-loaded foil 630 provides the dampening to the axial load applied by the radial shaft 409. When the pump system 400 is in operation at high speeds, the fluid pocket 610 protects the spring-loaded foil 630 from deforming (e.g., plastically deforming). As noted above, when not in operation or at low speeds, the rotor shaft 404 can apply a radial load to the foil bearing 416. The spring-loaded foil 630 provides a spring dampening to the load applied by the rotor shaft 404 to prevent damage to the journal lining 620, and consequently, the pump system 400. In some examples, the spring-loaded foil 630 implements means for dampening a load applied by the radial shaft 409 to the example thrust bearing 800.

The inner lining 640 of FIG. 9, similar to the inner lining 640 of FIG. 6, is displaced between the spring-loaded foil 630 and the radial shaft 409. In some examples, the inner lining 640 includes a friction-less coating to reduce friction caused by the pressurized fluid in the fluid pocket 610. Such an example coating may include Teflon™ or any other suitable friction-less/low-friction coating. The inner lining 640 provides a buffer surface between the spring-loaded foil 630 and the radial shaft 409. In some examples, the inner lining 640 provides an evenly distributed load to the spring-loaded foil 630 when the radial shaft 409 is applying an axial load. In some examples, the inner lining 640 implements means for separating a radial shaft 409 from the spring-loaded foil 630.

In the illustrated example of FIG. 9, the deformation limiter 650 is coupled to/manufactured with the journal lining 620. When an axial load is applied to the spring-loaded foil 630, the deformation limiter 650 defines a maximum plastic deformation in which the spring-loaded foil 630 may be deformed (e.g., a structural maximum amount of deformation). The use of the deformation limiter 650 prevents damage to the journal lining 620, and consequently the pump system 400, by eliminating the possibility of the radial shaft 409 directly contacting the journal lining 620. As disclosed above, in some examples, the deformation limiter 650 implements means for reducing a deformation to the spring-loaded foil 630.

In the examples disclosed herein, the deformation limiter 650 may be sized per a parameterization function, such that a size of the deformation limiter 650 can be obtained by evaluating a maximum amount of axial deformation allowable, a minimum clearance that needs to be maintained between the spring-loaded foil 630 and the deformation limiter 650 (or, more generally, a minimum clearance between the radial shaft 409 and the journal lining 620), a maximum load applied by the radial shaft 409, or any other list of suitable parameters. For example, the parameterization function can characterize one or more rotating regions within the pump such that a maximum amount of allowable radial deformation prevents clearance closure and rubbing at the impeller and/or seals, etc. In some examples, the parameterization function may be an exponential expansion of the required size of the deformation limiter 650 based upon the changes to any one of or combination of parameters, such as the parameters listed above. In other examples, a polynomial function may be used to characterize each parameter and determine the size of the deformation limiter 650. As such, the size, shape, and location of the deformation limiter 650 is not limited to the examples disclosed herein. The deformation limiter 650 can be used on various other types of bearing within a pump system and within other systems.

From the foregoing, it will be appreciated that example systems, methods, apparatus, and articles of manufacture have been disclosed that reduce failure to bearings in a pump system. The bearings disclosed herein can be foil bearings for supporting a radial load and/or a thrust bearing for supporting an axial load. The disclosed systems, methods, apparatus, and articles of manufacture reduce failure to bearings by adding a structural deformation limiter inside the spring-loaded foil of a bearing to define a maximum deformation of the spring-loaded foil when a load (e.g., a force) is applied to the spring-loaded foil that exceeds rated limits.

Further aspects of the presently disclosed subject matter are provided by the following clauses. Example methods, apparatus, systems, and articles of manufacture to reduce failure to bearings in a pump system are disclosed herein. Further examples and combinations thereof include the following:

Example 1 includes a pump system comprising a shaft connected to an impeller of the pump system, and a bearing to provide a dampening to the shaft, the bearing including a journal lining, the journal lining supported in the pump system, a spring-loaded foil to separate the shaft from the journal lining, an inner lining between the shaft and the spring-loaded foil, and a deformation limiter located between the spring-loaded foil and the journal lining.

Example 2 includes the pump system of any preceding clause, wherein the deformation limiter is coupled to the journal lining.

Example 3 includes the pump system of any preceding clause, wherein the deformation limiter is manufactured with the journal lining and made of the same material as the journal lining.

Example 4 includes the pump system of any preceding clause, wherein the deformation limiter is coupled to the spring-loaded foil.

Example 5 includes the pump system of any preceding clause, wherein the deformation limiter is manufactured with the spring-loaded foil and is made of the same material as the spring-loaded foil.

Example 6 includes the pump system of any preceding clause, wherein the deformation limiter is to establish a maximum deformation of the spring-loaded foil while the pump system is inoperable.

Example 7 includes the pump system of any preceding clause, wherein the deformation limiter is to establish a maximum deformation of the spring-loaded foil while the pump system is in operation.

Example 8 includes the pump system of any preceding clause, wherein the bearing is a radial foil bearing, wherein the deformation limiter is to establish a maximum radial deformation of the radial foil bearing due to a radial load applied by the shaft to the radial foil bearing.

Example 9 includes the pump system of any preceding clause, wherein the bearing is an axial thrust bearing, wherein the deformation limiter is to establish a maximum axial deformation of the axial thrust bearing due to an axial load applied by the shaft to the axial thrust bearing.

Example 10 includes the pump system of any preceding clause, wherein a size of the deformation limiter is parametrized based upon a maximum deformation of the spring-loaded foil due to a load from the shaft being applied to the spring-loaded foil.

Example 11 includes the pump system of any preceding clause, wherein the deformation limiter size is parametrized based upon at least one of a maximum deformation allowable, a minimum clearance maintainable between the shaft and the journal lining, or a maximum load applied by the shaft.

Example 12 includes the pump system of any preceding clause, wherein the bearing is at least one of a foil bearing or a thrust bearing.

Example 13 includes a bearing comprising a housing, a journal lining, the journal lining supported in the housing, a spring-loaded foil to separate a shaft from the journal lining, an inner lining between the spring-loaded foil and the shaft, and a deformation limiter located between the spring-loaded foil and the journal lining.

Example 14 includes the bearing of any preceding clause, wherein the deformation limiter is coupled to the journal lining.

Example 15 includes the bearing of any preceding clause, wherein the deformation limiter is manufactured with the journal lining and made of the same material as the journal lining.

Example 16 includes the bearing of any preceding clause, wherein the deformation limiter is coupled to the spring-loaded foil.

Example 17 includes the bearing of any preceding clause, wherein the deformation limiter is manufactured with the spring-loaded foil and is made of the same material as the spring-loaded foil.

Example 18 includes the bearing of any preceding clause, wherein the bearing is used within a pump system.

Example 19 includes the bearing of any preceding clause, wherein the deformation limiter is to establish a maximum deformation of the spring-loaded foil while the pump system housing the bearing is inoperable.

Example 20 includes the bearing of any preceding clause, wherein the deformation limiter is to establish a maximum deformation of the spring-loaded foil while the pump system housing the bearing is in operation.

Example 21 includes the bearing of any preceding clause, wherein the bearing is a radial foil bearing, wherein the deformation limiter is to establish a maximum radial deformation of the radial foil bearing due to a radial load applied by the shaft to the radial foil bearing.

Example 22 includes the bearing of any preceding clause, wherein the bearing is an axial thrust bearing, wherein the deformation limiter is to establish a maximum axial deformation of the axial thrust bearing due to an axial load applied by the shaft to the axial thrust bearing.

Example 23 includes the bearing of any preceding clause, wherein a size of the deformation limiter is parametrized based upon a maximum deformation of the spring-loaded foil due to a load from the shaft being applied to the spring-loaded foil.

Example 24 includes the bearing of any preceding clause, wherein the deformation limiter size is parametrized based upon at least one of a maximum deformation allowable, a minimum clearance maintainable between the shaft and the journal lining, or a maximum load applied by the shaft.

Example 25 includes the bearing of any preceding clause, wherein the bearing is at least one of a foil bearing or a thrust bearing.

Example 26 includes a gas turbine engine for an aircraft, the turbine engine comprising a nacelle, a plurality of fan blades inside the nacelle to produce fluid flow, an outer casing aft of the plurality of fan blades, a thermal management system within the outer casing, the thermal management system including a pump system to move fluid through the thermal management system, the pump system including a shaft connected to an impeller of the pump system, and a bearing to provide a dampening to the shaft, the bearing including a journal lining, the journal lining supported in the pump system, a spring-loaded foil to separate the shaft from the journal lining, an inner lining between the shaft and the spring-loaded foil, and a deformation limiter located between the spring-loaded foil and the journal lining.

Example 27 includes the turbine engine of any preceding clause, wherein the deformation limiter is coupled to the journal lining.

Example 28 includes the turbine engine of any preceding clause, wherein the deformation limiter is manufactured with the journal lining and made of the same material as the journal lining.

Example 29 includes the turbine engine of any preceding clause, wherein the deformation limiter is coupled to the spring-loaded foil.

Example 30 includes the turbine engine of any preceding clause, wherein the deformation limiter is manufactured with the spring-loaded foil and is made of the same material as the spring-loaded foil.

Example 31 includes the turbine engine of any preceding clause, wherein the deformation limiter is to establish a maximum deformation of the spring-loaded foil while the pump system is inoperable.

Example 32 includes the turbine engine of any preceding clause, wherein the deformation limiter is to establish a maximum deformation of the spring-loaded foil while the pump system is in operation.

Example 33 includes the turbine engine of any preceding clause, wherein the bearing is a radial foil bearing, wherein the deformation limiter is to establish a maximum radial deformation of the radial foil bearing due to a radial load applied by the shaft to the radial foil bearing.

Example 34 includes the turbine engine of any preceding clause, wherein the bearing is an axial thrust bearing, wherein the deformation limiter is to establish a maximum axial deformation of the axial thrust bearing due to an axial load applied by the shaft to the axial thrust bearing.

Example 35 includes the turbine engine of any preceding clause, wherein a size of the deformation limiter is parametrized based upon a maximum deformation of the spring-loaded foil due to a load from the shaft being applied to the spring-loaded foil.

Example 36 includes the turbine engine of any preceding clause, wherein the deformation limiter size is parametrized based upon at least one of a maximum deformation allowable, a minimum clearance maintainable between the shaft and the journal lining, or a maximum load applied by the shaft.

Example 37 includes the turbine engine of any preceding clause, wherein the bearing is at least one of a foil bearing or a thrust bearing.

Example 38 includes a bearing comprising means for separating a shaft from the bearing, means for dampening a load applied by the shaft to the bearing, and means for reducing a deformation to the dampening means.

The following claims are hereby incorporated into this Detailed Description by this reference. Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

What is claimed is:

1. A bearing comprising:
an outer lining;
a spring-loaded lining;
a deformation limiter, the deformation limiter located between the spring-loaded lining and the outer lining;
an inner lining, the spring-loaded lining between the outer lining and the inner lining; and
a fluid pocket, the fluid pocket between the inner lining and a rotor shaft, wherein the fluid pocket is configured to include a pressurized fluid to create a barrier between the rotor shaft and the inner lining.

2. The bearing of claim 1, wherein a size of the deformation limiter is based on a parameterization function, the parameterization function including at least one of a maximum amount of allowable radial deformation, a minimum clearance between the spring-loaded lining and the deformation limiter, or a maximum load applied to the rotor shaft.

3. The bearing of claim 1, wherein the pressurized fluid is compressed air from a pump system of a gas turbine engine.

4. The bearing of claim 1, wherein the bearing is a thrust bearing, and the fluid pocket is disposed within a thrust bearing assembly of a pump system.

5. The bearing of claim 4, wherein the fluid pocket is disposed in a longitudinal direction relative to the rotor shaft.

6. The bearing of claim 1, wherein the bearing is a foil bearing, and the fluid pocket is disposed circumferentially between the rotor shaft and the inner lining.

7. A pump system comprising:
a shaft; and
a bearing to dampen the shaft, the bearing including:
an outer lining, the outer lining supported in the pump system;
a spring-loaded lining to separate the shaft from the outer lining;
a deformation limiter, the deformation limiter located between the spring-loaded lining and the outer lining;
an inner lining, the spring-loaded lining between the outer lining and the inner lining; and
a fluid pocket, the fluid pocket between the inner lining and a rotor shaft, wherein the fluid pocket includes a pressurized fluid to create a barrier between the shaft and the inner lining.

8. The pump system of claim 7, wherein a size of the deformation limiter is based on a parameterization function, the parameterization function including at least one of a maximum amount of allowable radial deformation, a minimum clearance between the spring-loaded lining and the deformation limiter, or a maximum load applied to the rotor shaft.

9. The pump system of claim 7, wherein the pressurized fluid is compressed air from the pump system of a gas turbine engine.

10. The pump system of claim 7, wherein the bearing is a thrust bearing, and the fluid pocket is disposed within a thrust bearing assembly of the pump system.

11. The pump system of claim 10, wherein the fluid pocket is disposed in a longitudinal direction relative to the shaft.

12. The pump system of claim 7, wherein the bearing is a foil bearing, and the fluid pocket is disposed circumferentially between the shaft and the inner lining.

* * * * *